US009511269B2

(12) United States Patent
Morin et al.

(10) Patent No.: US 9,511,269 B2
(45) Date of Patent: Dec. 6, 2016

(54) BUTT-END APPARATUS FOR A LACROSSE STICK OR OTHER SPORT IMPLEMENT

(71) Applicant: Performance Lacrosse Group Inc., Liverpool, NY (US)

(72) Inventors: Kyle Morin, Rye, NH (US); David Winthrop Fream, Newfields, NH (US); Steven Joseph Kennedy, Niskayuna, NY (US)

(73) Assignee: Performance Lacrosse Group Inc., Liverpool, NY (US)

( * ) Notice: Subject to any disclaimer, the term of this patent is extended or adjusted under 35 U.S.C. 154(b) by 0 days.

(21) Appl. No.: 14/143,973

(22) Filed: Dec. 30, 2013

(65) Prior Publication Data

US 2015/0182829 A1 Jul. 2, 2015

(51) Int. Cl.
*A63B 59/02* (2006.01)
*A63B 65/12* (2006.01)

(52) U.S. Cl.
CPC ..... *A63B 59/20* (2015.10); *A63B 60/16* (2015.10); *A63B 60/28* (2015.10); *A63B 60/50* (2015.10); *A63B 2102/14* (2015.10); *A63B 2102/24* (2015.10)

(58) Field of Classification Search
CPC ..... A63B 59/02; A63B 65/12
USPC ..... 473/505, 512, 513; D21/724
See application file for complete search history.

(56) References Cited

U.S. PATENT DOCUMENTS 3,740,053 A * 6/1973 Eiger ..... A63B 69/3638 473/206
D235,791 S * 7/1975 Kurtz et al. ..... D21/759
4,037,841 A * 7/1977 Lewis, Jr. ..... 473/513
4,052,059 A * 10/1977 Rigsby ..... 473/560
4,588,191 A * 5/1986 Stewart ..... 473/256
D290,150 S * 6/1987 Stewart ..... D21/759
5,163,685 A 11/1992 Rhodes
5,335,919 A 8/1994 Soong
5,460,378 A * 10/1995 Getts ..... 473/251
D367,511 S * 2/1996 James ..... D21/759
D438,585 S * 3/2001 Pelot ..... D21/753
6,328,666 B1 * 12/2001 Manory ..... 473/437
6,379,286 B1 * 4/2002 Scopino et al. ..... 482/93
6,612,936 B1 * 9/2003 Matias ..... 473/256

(Continued)

OTHER PUBLICATIONS

Webpage download, Climaxmetal2004 , 2004, web.archive.org/web/20040601000000*/http://www.climaxmetal.com/prod_2p1.htm, 1 page.*

(Continued)

*Primary Examiner* — Gene Kim
*Assistant Examiner* — M Chambers
(74) *Attorney, Agent, or Firm* — Wolf, Greenfield & Sacks, P.C.

(57) ABSTRACT

A butt-end apparatus for a lacrosse stick or other sport implement. The butt-end apparatus comprises a hand abutment comprising: a handle-facing surface to face a handle of the lacrosse stick or other sport implement; and a hand-engaging surface to engage a hand of a player when holding the lacrosse stick or other sport implement. A position of the hand-engaging surface along the handle relative to a longitudinal end of the lacrosse stick or other sport implement is adjustable. An end cap may be mountable to a longitudinal end of a shaft of the lacrosse stick or other sport implement to define the longitudinal end of the lacrosse stick or other sport implement.

19 Claims, 8 Drawing Sheets

(56) References Cited

U.S. PATENT DOCUMENTS

| | | | | |
|---|---|---|---|---|
| 6,939,273 | B2 * | 9/2005 | Zajac et al. | 482/93 |
| 8,157,709 | B2 | 4/2012 | Wilkinson et al. | |
| 8,313,392 | B2 | 11/2012 | White | |
| 8,449,411 | B2 | 5/2013 | LeVault et al. | |
| 2004/0176194 | A1 * | 9/2004 | Mitchell | 473/437 |
| 2004/0248676 | A1 * | 12/2004 | Taylor et al. | 473/513 |
| 2005/0096159 | A1 * | 5/2005 | Houston et al. | 473/513 |
| 2005/0233839 | A1 * | 10/2005 | Adams | A63B 59/02 473/513 |
| 2005/0282666 | A1 * | 12/2005 | Morrow | A63B 60/10 473/513 |
| 2008/0248899 | A1 * | 10/2008 | Whitten et al. | 473/446 |
| 2009/0253539 | A1 * | 10/2009 | LoVine | 473/513 |
| 2012/0122616 | A1 * | 5/2012 | DePhillips et al. | 473/446 |
| 2012/0202622 | A1 * | 8/2012 | Sena | A63B 69/00 473/446 |
| 2013/0172136 | A1 | 7/2013 | Heiberg | |
| 2015/0182829 | A1 * | 7/2015 | Morin | A63B 59/02 473/513 |

OTHER PUBLICATIONS

Webpage download, Winco2011 , 2011, factory- automation. blogspot.com/2010/12/tube- end- plugs- can- be- used- on- office. html, 1 page.*

STX Catalog, 2006, 5 pages.*

Webpage download, Maverik2014, 2014, https://www.youtube.com/watch?v=7Olg8uFsn_0, 2 pages.*

Webpage download, elacrosse, 2003, www.e-lacrosse.com/stech67.html, 1 page.*

Webpage download, news2005, 2005, news.thomasnet.com/fullstory/mounting-collar-attaches-items-to-tube-or-pipe-470273, 4 pages.*

Webpage download, iec-corp2011, 2011, //web.archive.org/web/20110629053507/http://www.iec-corp.com/, 1 page.*

Webpage download, Elacrosse2007, 2007, www.e-lacrosse.com/stech802.html, 1 page.*

Webpage download, Bearingboys2011 , 2011, //www.bearingboys.co.uk/CADB38Z__-__38mm__Shaft__Collar__Double__Split__-40390-, 2 pages.*

Webpage download, Facilityhardware2011, 2011, www.facilityhardware.com/products/Furniture-Repair/4722/S53-15/0812, 4 pages.*

Webpage download, Laxallstars2013, 2013, laxallstars.com/butt-ends-shafts-and-tape-2013-rules-update/ , 1 page.*

Webpage download, youtube2013, 2013, www.youtube.com/watch?v=MgfTwSEPxKQ, 5 pages.*

Webpage download, Ruland2009, 2009, www.ruland.com/ps__collars__shaft__qcl.asp, 8 pages.*

Webpage download, Themetalstore2012, 2012, www.themetalstore.co.uk/products/end-caps, 1 page.*

* cited by examiner

BUTT-END APPARATUS FOR A LACROSSE STICK OR OTHER SPORT IMPLEMENT

FIELD

The invention relates generally to sport implements and, more particularly, to a butt-end apparatus for a sport implement such as a lacrosse stick.

BACKGROUND

Sport implements are used in various sports to throw, strike, or otherwise move a ball, puck, or other object.

For example, in lacrosse, a player uses a lacrosse stick to carry, pass, and shoot a lacrosse ball during a game. The lacrosse stick includes a head for catching, carrying, and throwing the lacrosse ball and a shaft comprising a handle for holding the lacrosse stick. A butt-end region of the handle is typically provided with a hand abutment to abut a hand of the player. This hand abutment may be formed by an end cap mounted at a longitudinal end of the shaft and/or by tape wrapped in the butt-end region.

Existing end caps or tape to provide a hand abutment in a lacrosse stick's butt-end region basically fix the hand abutment's position, such that it is impractical or not readily possible to adjust the hand abutment's position along the lacrosse stick's handle. In some cases, the hand abutment may not be positioned where the player would like to have it located and this may have adverse effects on the player's control or "feel" of the lacrosse stick. Also, existing end caps often have a shape that is bulky or otherwise not particularly well adapted to handles of lacrosse sticks on which they are used.

Similar issues may arise in other sports, such as hockey or baseball, in which players use sticks or other sports implements.

For these and other reasons, there is a need for improvements in lacrosse sticks and other sports implements.

SUMMARY

According to an aspect of the invention, there is provided a butt-end apparatus for a lacrosse stick. The lacrosse stick comprises a shaft and a head. The shaft comprises a handle for holding the lacrosse stick. The butt-end apparatus comprises: an end cap mountable to a longitudinal end of the shaft to define a longitudinal end of the lacrosse stick; and a hand abutment comprising a hand-engaging surface to engage a hand of a player when holding the lacrosse stick. The hand-engaging surface is movable along the handle to adjust a position of the hand-engaging surface along the handle relative to the longitudinal end of the lacrosse stick.

According to another aspect of the invention, there is provided a butt-end apparatus for a lacrosse stick. The lacrosse stick comprises a shaft and a head. The shaft comprises a handle for holding the lacrosse stick. The butt-end apparatus comprises a hand abutment comprising: a handle-facing surface to face the handle; and a hand-engaging surface to engage a hand of a player when holding the lacrosse stick. The hand abutment is slideable along the handle to adjust a position of the hand-engaging surface along the handle relative to a longitudinal end of the lacrosse stick.

According to another aspect of the invention, there is provided a butt-end apparatus for a lacrosse stick. The lacrosse stick comprises a shaft and a head. The shaft comprises a handle for holding the lacrosse stick. The handle comprises a generally polygonal outer surface. The butt-end apparatus comprises a hand abutment comprising: a handle-engaging surface to engage the handle, the handle-engaging surface being generally polygonal and complementary to the generally polygonal outer surface of the handle; and a hand-engaging surface to engage a hand of a player when holding the lacrosse stick. The hand-engaging surface is movable along the handle to adjust a position of the hand-engaging surface along the handle relative to a longitudinal end of the lacrosse stick.

According to another aspect of the invention, there is provided a butt-end apparatus for a lacrosse stick. The lacrosse stick comprises a shaft and a head. The shaft comprises a handle for holding the lacrosse stick. The butt-end apparatus comprises a hand abutment comprising: a handle-facing surface to face the handle; and a hand-engaging surface to engage a hand of a player when holding the lacrosse stick. The hand-engaging surface is movable along the handle to adjust a position of the hand-engaging surface along the handle relative to a longitudinal end of the lacrosse stick. The position of the hand-engaging surface along the handle relative to the longitudinal end of the lacrosse stick is adjustable while the handle-facing surface extends across more than half of a perimeter of a cross-section of the handle.

According to another aspect of the invention, there is provided a butt-end apparatus for a lacrosse stick. The lacrosse stick comprises a shaft and a head. The shaft comprises a handle for holding the lacrosse stick. The handle comprises a cavity. The butt-end apparatus comprises an end cap comprising: an insertable portion for insertion into the cavity of the handle; and an end portion for defining a longitudinal end of the lacrosse stick. The end portion comprises an outer surface shaped to substantially match an outer surface of the handle.

According to another aspect of the invention, there is provided a butt-end apparatus for a sports implement. The sports implement comprises an elongated member comprising a handle for holding the sports implement. The butt-end apparatus comprises: an end cap mountable to a longitudinal end of the elongated member to define a longitudinal end of the sports implement; and a hand abutment comprising a hand-engaging surface to engage a hand of a player when holding the sports implement. The hand-engaging surface is movable along the handle to adjust a position of the hand-engaging surface along the handle relative to the longitudinal end of the sports implement.

According to another aspect of the invention, there is provided a butt-end apparatus for a sports implement. The sports implement comprises an elongated member comprising a handle for holding the sports implement. The butt-end apparatus comprises a hand abutment which comprises a handle-facing surface to face the handle and a hand-engaging surface to engage a hand of a player when holding the sports implement. The hand abutment is slideable along the handle to adjust a position of the hand-engaging surface along the handle relative to a longitudinal end of the sports implement.

According to another aspect of the invention, there is provided a butt-end apparatus for a sports implement. The sports implement comprises an elongated member comprising a handle for holding the sports implement. The handle comprises a generally polygonal outer surface. The butt-end apparatus comprises: a hand abutment comprising a handle-engaging surface to engage the handle, the handle-engaging surface being generally polygonal and complementary to the generally polygonal outer surface of the handle; and a hand-engaging surface to engage a hand of a player when holding the sports implement. The hand-engaging surface is movable along the handle to adjust a position of the hand-engaging surface along the handle relative to a longitudinal end of the sports implement.

According to another aspect of the invention, there is provided a butt-end apparatus for a sports implement. The sports implement comprises an elongated member comprising a handle for holding the sports implement. The butt-end apparatus comprises a hand abutment comprising: a handle-facing surface to face the handle; and a hand-engaging surface to engage a hand of a player when holding the sports implement. The hand-engaging surface is movable along the handle to adjust a position of the hand-engaging surface along the handle relative to a longitudinal end of the sports implement. The position of the hand-engaging surface along the handle relative to the longitudinal end of the sports implement is adjustable while the handle-facing surface extends across more than half of a perimeter of a cross-section of the handle.

According to another aspect of the invention, there is provided a butt-end apparatus for a sports implement. The sports implement comprises an elongated member comprising a handle for holding the sports implement. The handle comprises a cavity. The butt-end apparatus comprises an end cap comprising: an insertable portion for insertion into the cavity of the handle; and an end portion for defining a longitudinal end of the sports implement. The end portion comprises an outer surface shaped to substantially match an outer surface of the handle.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

Figure 1:
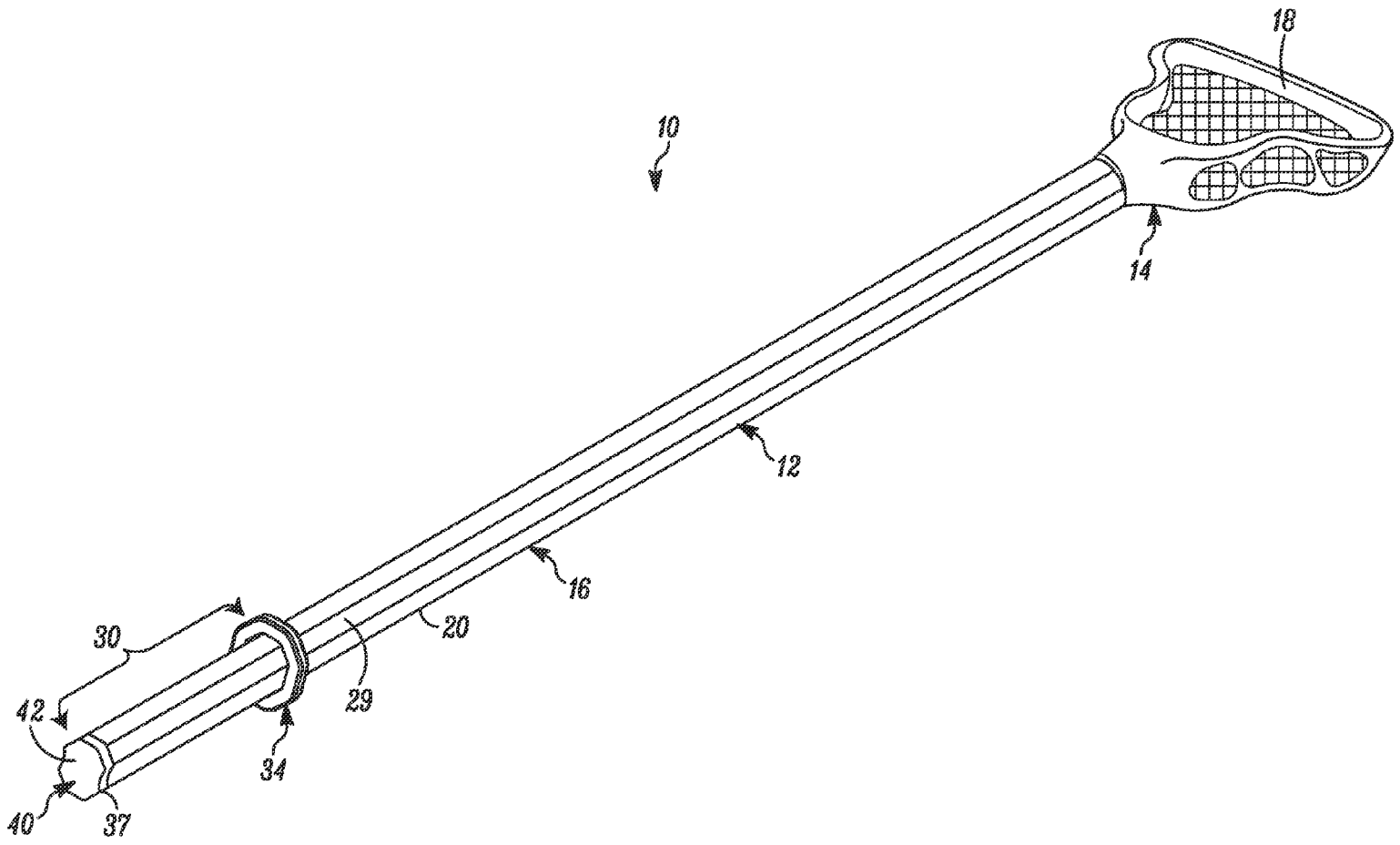
FIG. 1 shows an example of a sport implement for use by a player playing a sport, in accordance with an embodiment of the invention, in which the sport implement is a lacrosse stick.
Figure 2:
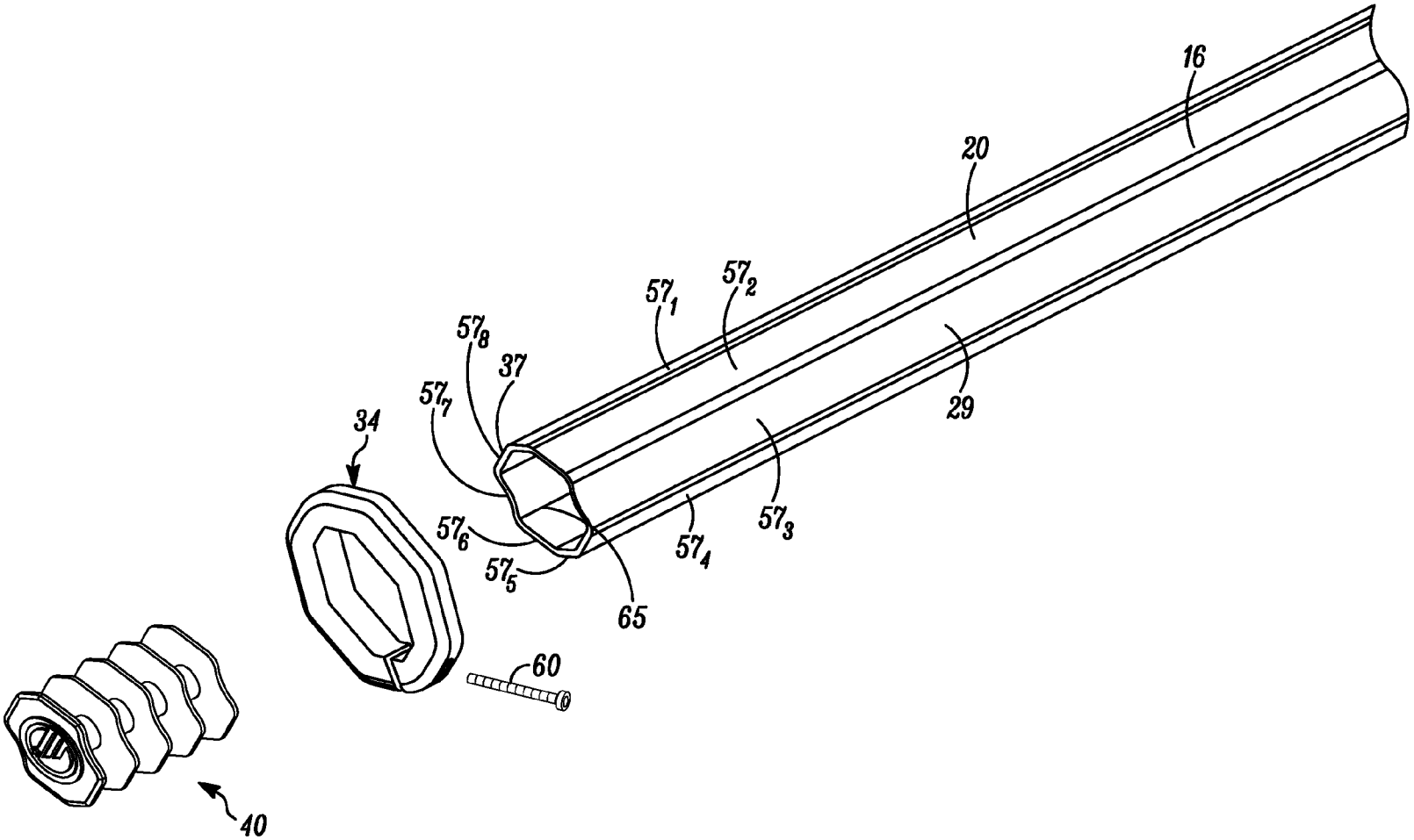
FIG. 2 shows an exploded view of a butt-end apparatus and part of a shaft of the lacrosse stick.

FIGS. 1 and 2 shows an example of a sport implement 10 for use by a player playing a sport, in accordance with an embodiment of the invention. The sport implement 10 comprises an elongate member 12 configured to be held by the player and an object-contacting member 14 configured to contact an object (e.g., a ball or puck) intended to be moved in a game. In this embodiment, the sport is lacrosse and the sport implement 10 is a lacrosse stick for use by the player to pass, shoot, carry, or otherwise move a lacrosse ball. The elongate member 12 comprises a shaft 16 of the lacrosse stick 10 and the object-contacting member 14 comprises a head 18 of the lacrosse stick. The shaft 16 comprises a handle 20 for holding the lacrosse stick 10.

The lacrosse stick 10 comprises a butt-end apparatus 30 comprising a hand abutment 34 which is adjustable to select where a hand of the player contacts the hand abutment 34. This may provide the player with better control or "feel" of the lacrosse stick 10 and may thus help to enhance the player's performance. In this embodiment, the butt-end apparatus 30 also comprises an end cap 40 mounted to a longitudinal end 37 of the shaft 16 to define a longitudinal end 42 of the lacrosse stick 10.

With additional reference to FIGS. 4A to 5C, the hand abutment 34 comprises a handle-facing surface 44 to face the handle 20 and a hand-engaging surface 46 to engage the player's hand when holding the lacrosse stick 10.

In this embodiment, the handle-facing surface 44 of the hand abutment 34 is a handle-engaging surface to engage the handle 20. In this example, the handle-engaging surface 44 delimits an opening 48 of the hand abutment 34 that receives the handle 20. More particularly, in this embodiment, the handle-engaging surface 44 has a shape generally complementary to a shape of an outer surface 29 of the handle 20. In this example, the outer surface 29 of the handle 20 is generally polygonal and the handle-engaging surface 44 is thus generally polygonal and complementary to the outer surface 29 of the handle 20. The outer surface 29 of the handle 20 is generally polygonal in that it includes a plurality of sides $\mathbf{57}_1$-$\mathbf{57}_8$ and, similarly, the handle-engaging surface 44 of the hand abutment 34 is generally polygonal in that it includes a plurality of sides $\mathbf{59}_1$-$\mathbf{59}_8$ which are arranged to face respective ones of the sides $\mathbf{57}_1$-$\mathbf{57}_8$ of the outer surface 29 of the handle 20. In this case, the outer surface 29 of the handle 20 is generally octagonal and the handle-engaging surface 44 is thus generally octagonal. In this case, therefore, the opening 48 of the hand abutment 34 that receives the handle 20 is generally octagonal. In this example, at least some of the sides $\mathbf{57}_1$-$\mathbf{57}_8$ of the outer surface 29 of the handle 20 are curved (e.g., to enhance prehension or tactile feedback). More specifically, in this example, the sides $\mathbf{57}_3$, $\mathbf{57}_7$ are curved (in this case concave), while the sides $\mathbf{57}_1$, $\mathbf{57}_2$, $\mathbf{57}_4$-$\mathbf{57}_6$, $\mathbf{57}_8$ are generally straight. Also, in this example, the sides $\mathbf{59}_1$-$\mathbf{59}_8$ of the handle-engaging surface 44 are generally straight and engage the sides $57_1$, $57_2$, $57_4$-$57_6$, $57_8$, end regions of the sides $57_3$, $57_7$, and edges between the sides $57_1$-$57_8$ of the outer surface 29 of the handle 20. The handle-engaging surface 44 of the hand abutment 34 and/or the outer surface 29 of the handle 20 may be configured in various other ways in other embodiments (e.g., have any number of sides, have any combination of curved and straight sides, have only curved sides or only straight sides, have a circular or other continuously curved perimeter, etc.).

The hand-engaging surface 46 of the hand abutment 34 is configured to contact the player's hand. More particularly, in this embodiment, the hand-engaging surface 46 projects away from the handle 20 in a transversal direction of the lacrosse stick 10 (i.e., a direction transversal to a longitudinal axis of the lacrosse stick 10). A surface area of the hand-engaging surface 46 may have any suitable extent to properly abut the player's hand. In this embodiment, the hand-engaging surface 46 defines an outer periphery 39 of the hand abutment 34. More particularly, in this embodiment, the outer periphery 39 of the hand abutment 34 is generally polygonal. The outer periphery 39 of the hand abutment 34 therefore includes a plurality of sides $67_1$-$67_8$. In this example, the outer periphery 39 of the hand abutment 34 is generally octagonal. The hand-engaging surface 46 may be configured in various other ways in other embodiments (e.g., have any other suitable shape).

In this embodiment, the hand abutment 34 comprises a ring 41 configured to substantially surround the handle 20. The ring 41 includes a rigid material 43. In this example, the rigid material 43 makes up at least a majority, in this case all, of the ring 41, including the handle-engaging surface 44 and the hand-engaging surface 46. For instance, in this embodiment, the rigid material 43 is nylon. In other embodiments, the rigid material 43 may be any thermoplastic material (e.g., acrylic or polyethylene), composite material such as a fiber-reinforced composite (e.g., a polymeric resin reinforced with carbon fibers, aramid fibers or glass fibers), metallic material (e.g., aluminum, brass, steel, alloys), ceramic material, or any other suitable material. The hand abutment 34 may be implemented in various other ways in other embodiments (e.g., have any other suitable shape and/or be made of any other suitable material).

The hand-engaging surface 46 of the hand abutment 34 is movable along the handle 20 to adjust a position of the hand-engaging surface 46 along the handle 20 relative to the longitudinal end 42 of the lacrosse stick 10. To that end, in this embodiment, the butt-end apparatus 30 comprises an adjustment mechanism 50 to allow movement of the hand-engaging surface 46 along the handle 20 to adjust the position of the hand-engaging surface 46.

More particularly, in this embodiment, the hand abutment 34 is slideable along the handle 20 to adjust the position of the hand-engaging surface 46 along the handle 20 relative to the longitudinal end 42 of the lacrosse stick 10.

Figure 6A:
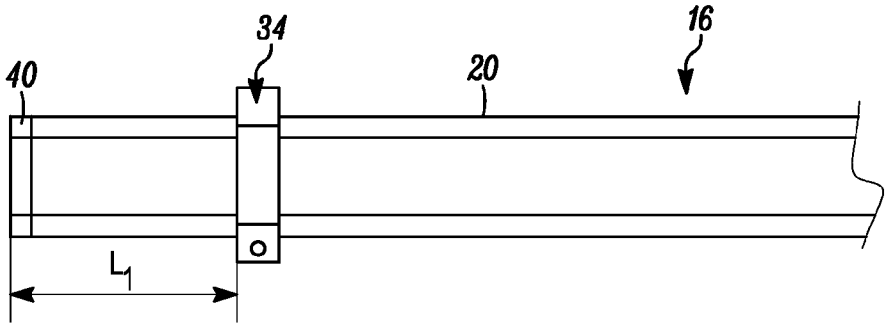
FIG. 6A shows a side view of the butt-end apparatus when a hand-engaging surface of the hand abutment is adjusted at a first position.
Figure 6B:
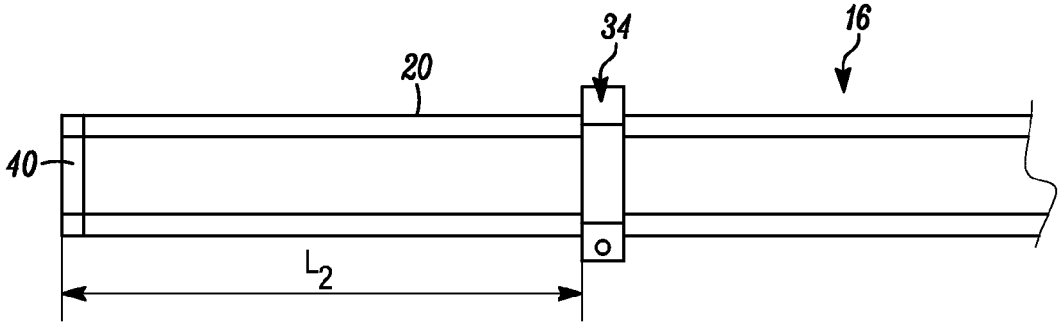
FIG. 6B shows a side view of the butt-end apparatus when the hand-engaging surface of the hand abutment is adjusted at a second position.

For example, in this embodiment, as shown in FIGS. 6A and 6B, the hand abutment 34 is slideable along the handle 20 to adjust the position of the hand-engaging surface 46 such that it lies at a distance $L_1$ from the longitudinal end 42 of the lacrosse stick 10. In another instance, the hand abutment 34 may be slid along the handle 20 such that the position of the hand-engaging surface 46 lies at a distance $L_2$ from the longitudinal end 42 of the lacrosse stick 10 which is greater than the distance $L_1$. Similarly, the position of the hand-engaging surface 46 may be adjusted at any other desired location along the handle 20. The hand-engaging surface 46 may then be secured at its desired position through the adjustment mechanism 50.

This adjustment in the positioning of the hand-engaging surface 46 can be beneficial to the player (e.g., to improve his/her stick handling capacity and/or "feel" of the lacrosse stick 10). For instance, this may allow some tailoring of an "effective" length of the lacrosse stick 10. For example, a shorter effective length may provide better stick handling characteristics which are typically desired particularly when playing an offensive position in lacrosse. A longer effective length may be desired when the player wishes to increase a reach of the lacrosse stick 10, such as in a defensive position. Thus, by modifying the position of the hand-engaging surface 46, the player may effectively simulate benefits of a shorter or longer stick as desired.

In this embodiment, the adjustment mechanism 50 comprises a fastener 60 operable to selectively (i) allow movement of the hand-engaging surface 46 along the handle 20 relative to the longitudinal end 42 of the lacrosse stick 10 and (ii) fix the position of the hand-engaging surface 46 along the handle 20 relative to the longitudinal end 42 of the lacrosse stick 10.

More particularly, in this embodiment, the fastener 60 is configured to clamp the hand abutment 34 onto the handle 20. To this end, in this embodiment, the fastener 60 comprises a threaded fastener comprising a tool-engaging head for engaging a tool and a threaded shank for engaging a threaded hole. In this embodiment, the fastener 60 is made of a ferrous metal (e.g. steel). However, in other variants, the fastener 60 may be made of any other suitable material including light weight materials (e.g., aluminum, polymers, etc.). When the fastener 60 is tightened, the hand abutment 34 clamps onto the handle 20 and is therefore held in place. Conversely, when the fastener 60 is loosened, the hand abutment 34 is unclamped from the handle 20 and can be moved along the handle 20. To facilitate this clamping action, in this embodiment, the ring 41 of the hand abutment 34 includes a discontinuity 71 that closes or opens when the fastener 60 is tightened or loosened.

In this embodiment, the hand abutment 34 comprises an opening 63 in which extends the fastener 60. In this example, the opening 63 comprises a threaded hole 62 and a through hole 61 for receiving the fastener 60. The fastener 60 is thus configured to extend in the opening 63 of the hand abutment 34 and engage the threaded hole 62 of the opening 63. More particularly, in this example, the fastener 60 is concealed (i.e., entirely located within) the opening 63 of the hand abutment 34. In other examples, the fastener 60 may be exposed when in the opening 63.

In this example of implementation, the position of the hand-engaging surface 46 along the handle 20 is adjustable while the handle-engaging surface 44 extends across more than half of a perimeter of a cross-section of the handle 20. More particularly, in this example, the position of the hand-engaging surface 46 along the handle 20 is adjustable while the handle-engaging surface 44 extends across at least three-quarters of the perimeter of the cross-section of the handle 20. In this case, the position of the hand-engaging surface 46 along the handle 20 is adjustable while the handle-engaging surface 44 extends across substantially an entirety of the perimeter of the cross-section of the handle 20. This may facilitate adjustment of the position of the hand-engaging surface 46 along the handle 20 by facilitating retention of the hand abutment 34 on the handle 20.

Figure 3A:
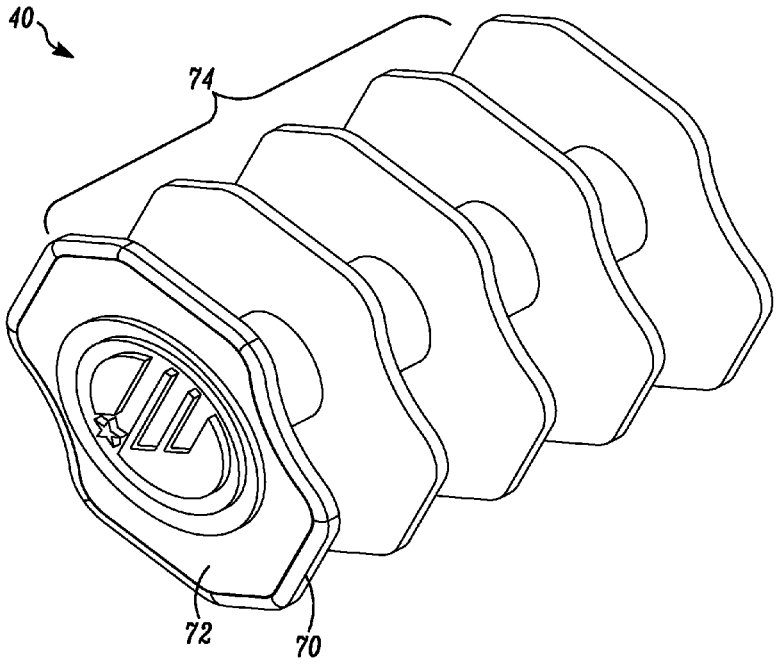
FIG. 3A shows a perspective view of an end cap of the butt-end apparatus.
Figure 3B:
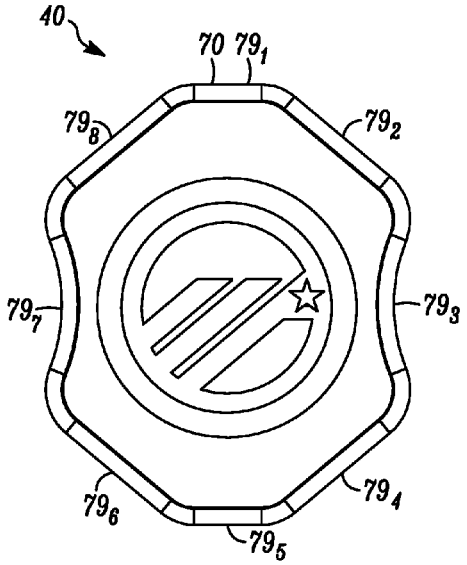
FIG. 3B shows a front view of the end cap.
Figure 3C:
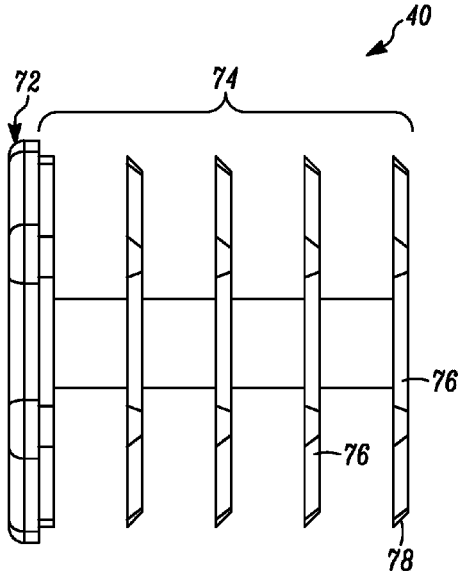
FIG. 3C shows a side view of the end cap.
Figure 4A:
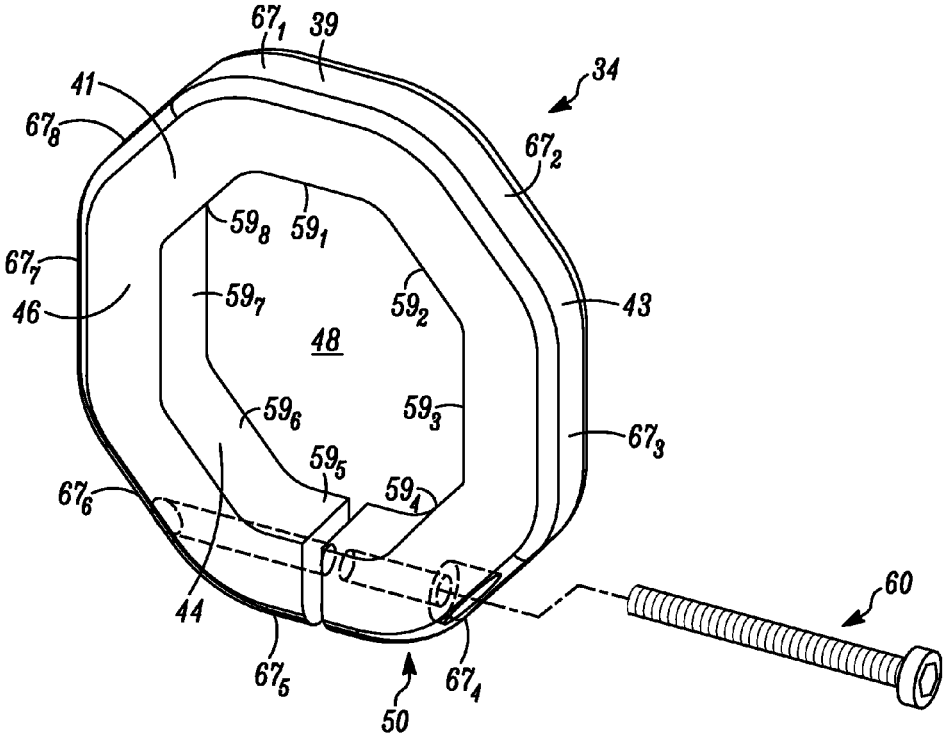
FIG. 4A shows a perspective view of a hand abutment of the butt-end apparatus.
Figure 4B:
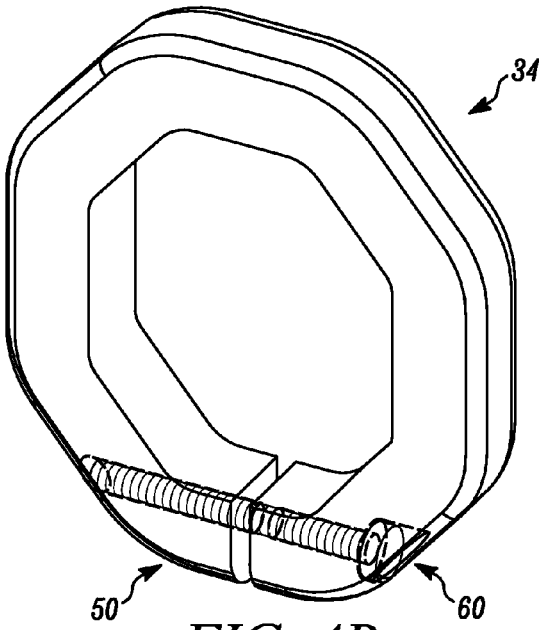
FIG. 4B shows a perspective view of an adjustment mechanism of the butt-end apparatus.
Figure 5A:
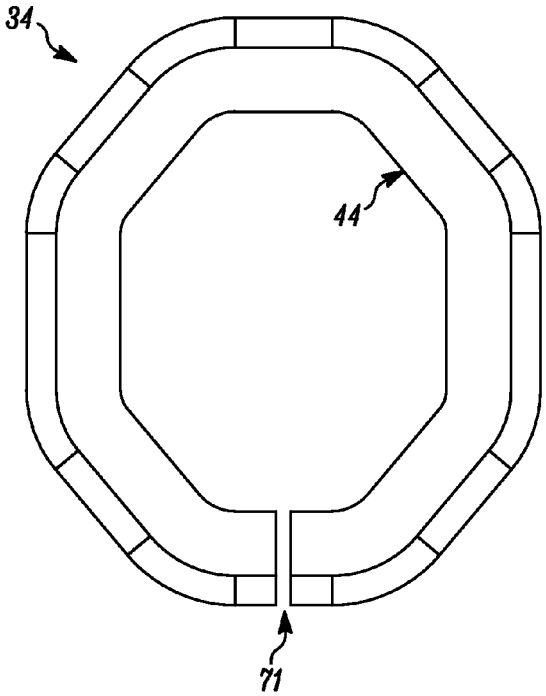
FIG. 5A shows a front view of the hand abutment.
Figure 5B:
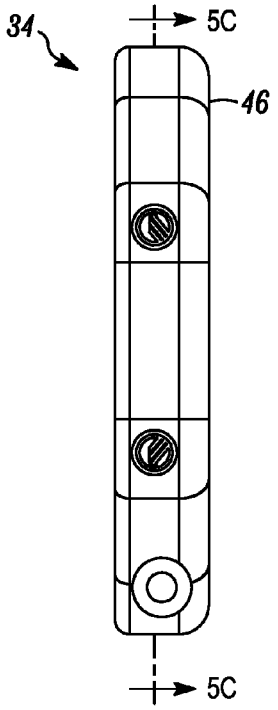
FIG. 5B shows a side view of the hand abutment.
Figure 5C:
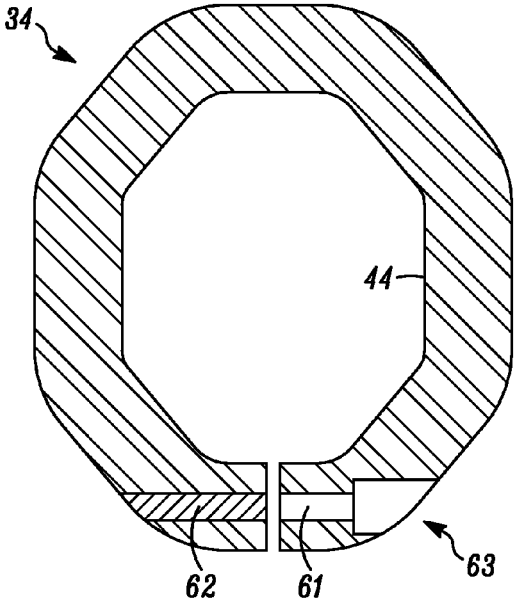
FIG. 5C shows a cross-sectional view of the hand abutment.

With additional reference to FIGS. 3A to 3C, in this embodiment, the end cap 40 is insertable into a cavity 65 of the handle 20. More particularly, in this embodiment, the end cap 40 comprises an end portion 72 and an insertable portion 74. The insertable portion 74 is configured to be inserted into the cavity 65 of the handle 20 and therefore may have a cross-sectional area comparable to (e.g., slightly smaller than) a cross-sectional area of the cavity 65. The end portion 72 closes off the cavity 65 and is visible when the end cap 40 is mounted to the handle 20. Also, in this example, the end portion 72 serves as a stop to prevent the end cap 40 from fully entering within the cavity 65. For this reason, in this case, a diameter of the end portion 72 is larger than a diameter of the cavity 65.

In this embodiment, an outer surface 70 of the end portion 72 of the end cap 40 is shaped to substantially match the outer surface 29 of the handle 20. More particularly, in this embodiment, the outer surface 70 of the end portion 72 of the end cap 40 is generally polygonal, in this case octagonal, and substantially matches the outer surface 29 of the handle 29. For instance, in this case, the outer surface 70 of the end portion 72 of the end cap 40 is shaped to be substantially flush with the outer surface 29 of the handle 20. In this example, the outer surface 70 of the end portion 72 of the end cap 40 includes a plurality of sides $\mathbf{79}_1$-$\mathbf{79}_8$ which are arranged to be substantially flush with respective ones of the sides $\mathbf{57}_1$-$\mathbf{57}_8$ of the outer surface 29 of the handle 20. Thus, in this example, the sides $\mathbf{79}_3$, $\mathbf{79}_7$ are curved (in this case concave), while the sides $\mathbf{79}_1$, $\mathbf{79}_2$, $\mathbf{79}_4$-$\mathbf{79}_6$, $\mathbf{79}_8$ are generally straight. The outer surface 70 of the end portion 72 of the end cap 40 may be configured in various other ways in other embodiments (e.g., have any number of sides, have any combination of curved and straight sides, have only curved sides or only straight sides, have a circular or other continuously curved perimeter, etc.).

Also, in this embodiment, the end portion 72 of the end cap 40 comprises an end face 86 that is substantially flat. In this example, a mark 88 (e.g., a logo) is provided in the end face 86. For instance, in embodiments in which the end cap 40 is molded, the mark 88 may be molded into the end face 86 during molding of the end cap 40.

The end cap 40 may be made of any suitable material. In this embodiment, the end cap 40 is made of elastomeric material (e.g., rubber). However, in other embodiments, the end cap 40 may be made of thermoplastic material (e.g., nylon or polyethylene), metallic material (e.g., aluminum), or any other material.

The end cap 40 may be retained on the handle 20 in any suitable way. For example, in this embodiment, the end cap 40 is mountable in a press fit within the cavity 65 of the handle 20. More particularly, in this embodiment, the insertable portion 74 comprises a plurality of radially-extending sections 76 which are spaced apart from one another and are of an appropriate size so as to mate in a press fit engagement within the cavity 65 of the handle 20. In this example, the radially-extending sections 76 are generally of the same shape as the cavity 65 of the handle 20 and comprise a chamfer 78 on one longitudinal side thereof which facilitate insertion of the end cap 40 within the cavity 65 but acts against removal of the end cap 40 from the cavity 65. In other embodiments, the end cap 40 may be mounted to the handle 20 by a fastener (e.g., a threaded fastener or an adhesive).

In this embodiment, the hand abutment 34 is movable across the end cap 40 to mount the hand abutment 34 to the handle 20. In order to achieve this, in this example of implementation, dimensions of the end cap 40 and dimensions of the opening 48 of the hand abutment 34 allow for the hand abutment 34 to be moveable across the end cap 40 when the end cap 40 is already inserted into the cavity 65 of the handle 20. More particularly, in this embodiment, the outer surface 70 of the end portion 72 of the end cap 40 does not project beyond the outer surface 29 of the handle 20 in the transversal direction of the lacrosse stick 10.

In other embodiments, the end cap 40 may be implemented in various other ways. For example, in other embodiments, the end cap 40 may be mounted over the outer surface 29 of the handle 20 instead of within the cavity 65 of the handle 20 (e.g., the end cap 40 may comprise a cavity that receives an end part of the outer surface 29 of the handle 20).

The butt-end apparatus 30 may be implemented in various other ways in other embodiments.

Figure 7:
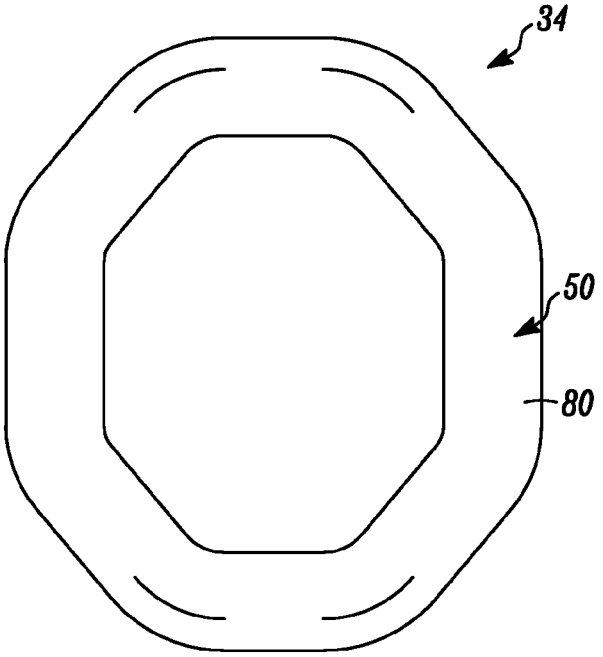
FIG. 7 shows an example of another embodiment wherein the adjustment mechanism comprises an elastic body.

For example, in some embodiments, the adjustment mechanism 50 of the butt-end apparatus 30, including its fastener 60, may be implemented in any other suitable manner. For example, in some embodiments, as shown in FIG. 7, the fastener 60 may be implemented as an elastic body 80 of the hand abutment 34 that is elastically stretchable to be stretched open to allow movement of the elastic body 80 along the handle 20 and, when the stretching force ceases to be applied, to contract onto the handle 20 and exert sufficient friction on the handle 20 to hold it in place against pressure from the player's hand. In yet another example, the adjustment mechanism 50 may comprise a quick-release clamp-on shaft collar or any other type of suitable clamping mechanism.

Figure 8:
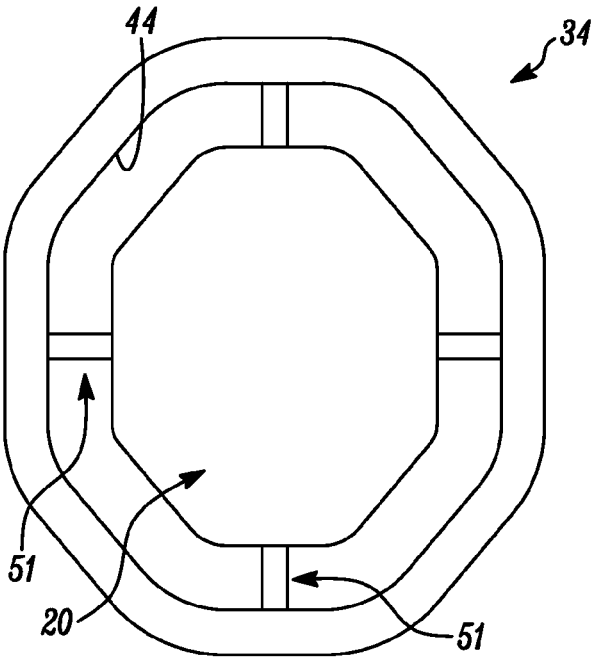
FIG. 8 shows an example of another embodiment wherein a handle-facing surface of the hand abutment is spaced from the shaft.

As another example, in some embodiments, the handle-facing surface 44 of the hand abutment 34 may not engage the handle 20 but may rather be spaced apart from the handle 20. For instance, in some embodiments, as shown in FIG. 8, the handle-facing surface 44 may be supported in a spaced apart relationship from the handle 20 by a plurality of arms 51 connected to the shaft 16. This may allow the hand abutment 34 to be narrower and thus lighter.

Figure 9:
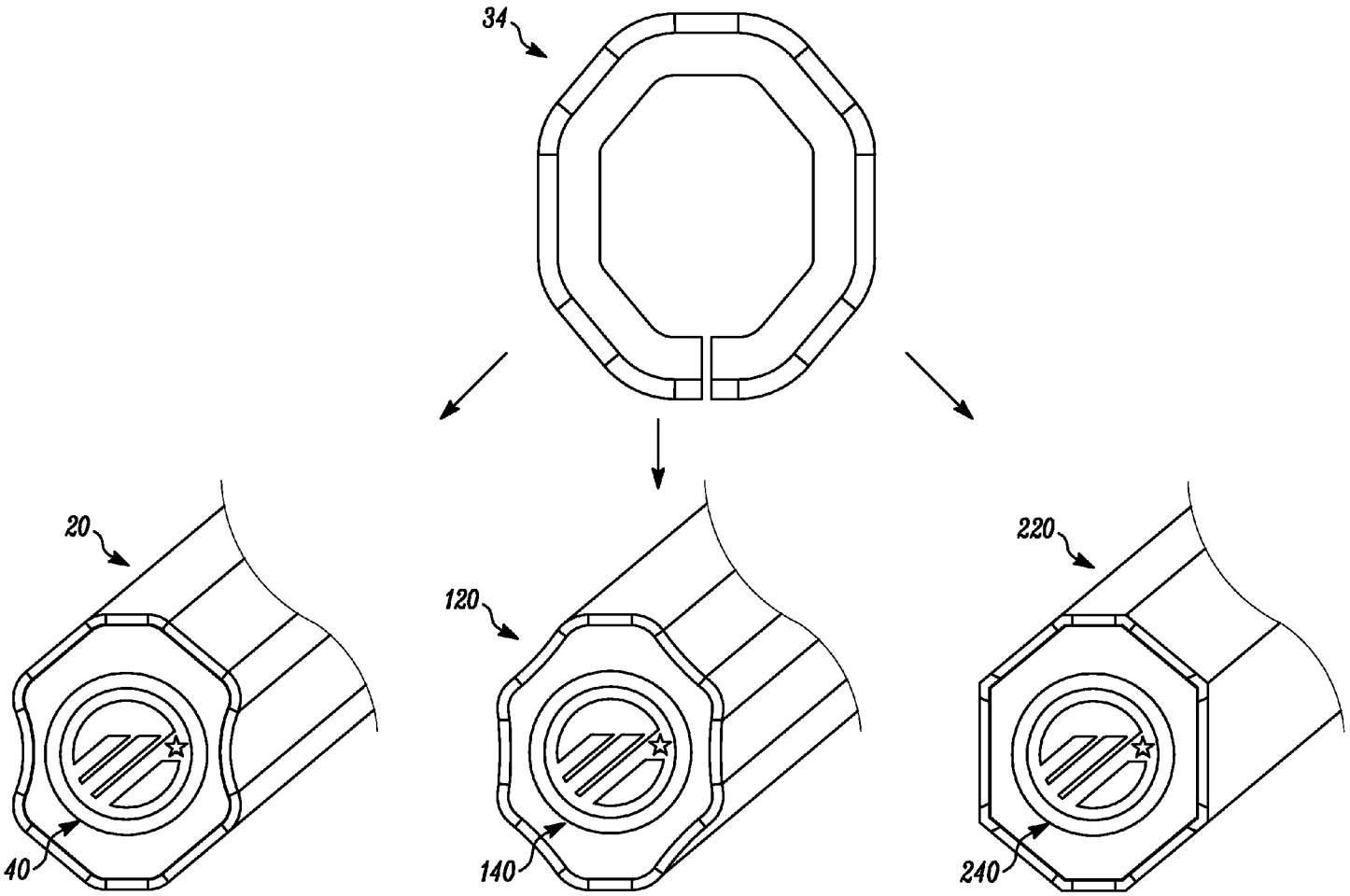
FIG. 9 shows an example of another embodiment in which the hand abutment may be usable in connection with a plurality of differently-shaped handles of lacrosse sticks.

In some examples of implementation, the hand abutment 34 may be usable in connection with a plurality of differently-shaped handles of lacrosse sticks. For instance, in some embodiments, as shown in FIG. 9, the hand abutment 34 may be usable in connection with the handle 20 of the lacrosse stick 10, a handle 120 of another lacrosse stick, and a handle 220 of yet another lacrosse stick which have different generally polygonal shapes but a common number of sides (in this case eight) and to which are respectively mounted the end cap 40, an end cap 140, and an end cap 240 that have corresponding generally polygonal shapes.

In some embodiments, the end cap 40 may be omitted from the butt-end apparatus 30, i.e., there may be no end cap. In such embodiments, the longitudinal end 37 of the shaft 16 defines the longitudinal end 42 of the lacrosse stick 10. Conversely, in some embodiments, the end cap 40 may be used on the lacrosse stick 10 but the hand abutment 34 may be omitted from the butt-end apparatus 30, i.e., there may be no hand abutment.

Although in this embodiment the sport implement 10 is a lacrosse stick, in other embodiments, the sport implement 10 may be any other implement used for striking, propelling or otherwise moving an object in a game of another sport. For example, in other embodiments, the sport implement 10 may be a hockey stick in which the object-contacting member 14 comprises a blade for passing, shooting or otherwise moving a hockey puck. As another example, in other embodiments, the sport implement 10 may be a baseball bat in which the object-contacting member 14 comprises a barrel for hitting a baseball.

Any feature of any embodiment discussed herein may be combined with any feature of any other embodiment discussed herein in some examples of implementation.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A lacrosse handle for a lacrosse stick, comprising:

an elongated lacrosse shaft having a first end and a second end, the second end being configured for attachment to a lacrosse stick head, the elongated lacrosse shaft having an outer surface;

a position adjustable hand abutment including a hand-engaging surface to engage a hand of a player when holding the lacrosse shaft, the hand abutment mounted to and being slidable along the lacrosse shaft to fixedly adjust a position of the hand-engaging surface along the lacrosse shaft relative to the first end, the hand abutment including a shaft-facing surface with a shape complementary to a shape of the outer surface of the lacrosse shaft, the position adjustable hand abutment being moveable between at least a first position and a second position spaced from the first position on the lacrosse shaft, and releasably fixable to the lacrosse shaft in each of the first position and the second position; and an end cap at the first end of the lacrosse shaft, the end cap having an outer perimeter and the shaft-facing surface of the hand abutment defining an opening that is larger than the outer perimeter of the end cap, wherein the shaft-facing surface of the hand abutment is slidable over the outer perimeter of the end ca to mount the hand abutment to or remove the hand abutment from, the lacrosse shaft.

2. The lacrosse handle of claim 1, wherein the hand abutment is adjustable while the shaft-facing surface extends across more than half of a perimeter of a cross-section of the lacrosse shaft.

3. The lacrosse handle of claim 2, wherein the shaft-facing surface extends across at least three-quarters of the perimeter of the cross-section of the lacrosse shaft.

4. The lacrosse handle of claim 3, wherein the shaft-facing surface extends across substantially an entirety of the perimeter of the cross-section of the lacrosse shaft.

5. The lacrosse handle of claim 1, wherein the end cap includes an end portion and a shape of an outer surface of the end portion of the end cap substantially matches an outer surface of the lacrosse shaft.

6. The lacrosse handle of claim 5, wherein the outer surface of the end portion of the end cap includes a plurality of sides which are substantially flush with respective ones of a plurality of sides of the outer surface of the lacrosse shaft.

7. The lacrosse handle of claim 6, wherein the plurality of sides of the outer surface of the end portion of the end cap includes a curved side and a generally straight side and the plurality of sides of the outer surface of the lacrosse shaft include a curved side and a generally straight side that correspond to the curved side and the generally straight side of the outer surface of the end portion of the end cap.

8. The lacrosse handle of claim 1, further comprising a fastener operable to selectively (i) allow movement of the hand abutment along the lacrosse shaft relative to the first end of the lacrosse shaft and (ii) fix the position of the hand-abutment along the lacrosse shaft relative to the first end.

9. The lacrosse handle of claim 8, wherein the fastener is configured to clamp the hand abutment onto the lacrosse shaft.

10. The lacrosse handle of claim 8, wherein the hand abutment comprises an opening and the fastener extends in the opening of the hand abutment.

11. The lacrosse handle of claim 10, wherein the fastener is concealed within the opening of the hand abutment.

12. The lacrosse handle of claim 10, wherein the fastener is a threaded fastener and the opening of the hand abutment comprises threads that engage the threaded fastener.

13. The lacrosse handle of claim 1, wherein the outer surface of the lacrosse shaft is generally polygonal, the shaft-facing surface of the hand abutment is generally polygonal and complementary to the generally polygonal outer surface of the lacrosse shaft, and the outer perimeter of the end cap is generally polygonal.

14. The lacrosse handle of claim 13, wherein the generally polygonal outer surface of the lacrosse shaft is generally octagonal, the shaft-facing surface is generally octagonal, and the outer perimeter of the end cap is generally octagonal.

15. The lacrosse handle of claim 1, wherein the end cap is inserted into a cavity of the lacrosse shaft.

16. The lacrosse handle of claim 15, wherein the end cap is fastened by a press fit within the cavity of the lacrosse shaft.

17. The lacrosse handle of claim 1, wherein the end cap does not project beyond an outer surface of the lacrosse shaft in a transversal direction of the lacrosse shaft.

18. The lacrosse handle of claim 1, wherein the shaft-facing surface of the hand abutment includes a rigid material.

19. The lacrosse handle of claim 1, wherein the hand abutment comprises a ring that substantially surrounds the lacrosse shaft.

* * * * *